US010159306B2

(12) United States Patent
Fujita et al.

(10) Patent No.: US 10,159,306 B2
(45) Date of Patent: Dec. 25, 2018

(54) SHOE SOLE

(71) Applicants: Yoshinori Fujita, Kobe (JP); Hisanori Fujita, Kobe (JP); Seiya Hayashi, Kobe (JP)

(72) Inventors: Yoshinori Fujita, Kobe (JP); Hisanori Fujita, Kobe (JP); Seiya Hayashi, Kobe (JP)

(73) Assignee: ASICS CORPORATION (JP)

( * ) Notice: Subject to any disclaimer, the term of this patent is extended or adjusted under 35 U.S.C. 154(b) by 318 days.

(21) Appl. No.: 15/027,682

(22) PCT Filed: Oct. 10, 2013

(86) PCT No.: PCT/JP2013/077630
§ 371 (c)(1),
(2) Date: Jul. 8, 2016

(87) PCT Pub. No.: WO2015/052813
PCT Pub. Date: Apr. 16, 2015

(65) Prior Publication Data

US 2016/0302523 A1 Oct. 20, 2016

(51) Int. Cl.
*A43B 13/14* (2006.01)
*A43B 13/18* (2006.01)
(Continued)

(52) U.S. Cl.
CPC ..... *A43B 13/184* (2013.01); *A43B 13/04* (2013.01); *A43B 13/122* (2013.01);
(Continued)

(58) Field of Classification Search
CPC ..... A43B 13/184; A43B 13/187; A43B 13/04; A43B 13/122; A43B 13/223; A43B 13/141; A43C 15/161
See application file for complete search history.

(56) References Cited

U.S. PATENT DOCUMENTS 4,747,220 A * 5/1988 Autry ..... A43B 13/26 36/114
4,897,936 A * 2/1990 Fuerst ..... A43B 13/12 36/114
(Continued)

FOREIGN PATENT DOCUMENTS

JP S63172302 U 11/1988
JP H01154805 U 10/1989
(Continued)

OTHER PUBLICATIONS

Extended European Search Report for European Patent Application No. 13 89 5386 dated May 31, 2017.
(Continued)

*Primary Examiner* — Katharine Gracz
(74) *Attorney, Agent, or Firm* — Katten Muchin; Rosenman LLP

(57) ABSTRACT

A shoe sole including: an outsole 1 and a mid sole 2, wherein: the outsole 1 includes: a plurality of cleats C1 arranged while being spaced apart from one another in a first direction D1; and a plurality of cleats C1 arranged while being spaced apart from one another in a second direction D2; ones of the cleats C1 that are adjacent to each other in a third direction D3 are continuous with each other in the third direction D3 via a first connecting portion 12 of the outsole; ones of the cleats C1 that are adjacent to each other in a fourth direction D4 are continuous with each other in the fourth direction D4 via a second connecting portion 13 of the outsole; a plurality of through holes H are provided, each through hole H being defined in an area surrounded by three or more of the cleats C1; and the lower surface 20 of the mid sole 2 includes: an attachment surface 22 attached to the upper surface 11 of the outsole 1, and an exposed surface 23 of the foamed material exposed through the through holes H.

16 Claims, 8 Drawing Sheets

(51) Int. Cl.

| | |
|---|---|
| ***A43B 13/12*** | (2006.01) |
| ***A43B 13/22*** | (2006.01) |
| ***A43B 13/04*** | (2006.01) |
| ***A43C 15/16*** | (2006.01) |

(52) U.S. Cl.
CPC ..... *A43B 13/141* (2013.01); *A43B 13/187* (2013.01); *A43B 13/223* (2013.01); *A43C 15/161* (2013.01)

(56) References Cited

U.S. PATENT DOCUMENTS

| | | | | |
|---|---|---|---|---|
| 5,155,927 | A | 10/1992 | Bates et al. | |
| 5,493,792 | A | 2/1996 | Bates et al. | |
| 5,718,063 | A | 2/1998 | Yamashita et al. | |
| 5,775,005 | A * | 7/1998 | McClelland | A43B 1/0072 36/134 |
| 6,199,302 | B1 | 3/2001 | Kayano | |
| 6,212,795 | B1 | 4/2001 | Nakabe et al. | |
| 6,438,870 | B2 | 8/2002 | Nasako et al. | |
| 6,467,197 | B1 | 10/2002 | Mitsui et al. | |
| 6,516,539 | B2 | 2/2003 | Nishiwaki et al. | |
| 6,647,646 | B2 | 11/2003 | Mitsui et al. | |
| 6,748,675 | B2 * | 6/2004 | Sato | A43B 13/12 36/28 |
| D495,859 | S | 9/2004 | Kubo et al. | |
| D495,860 | S | 9/2004 | Kubo et al. | |
| D496,148 | S | 9/2004 | Kayano et al. | |
| D501,713 | S | 2/2005 | Kayano et al. | |
| D501,987 | S | 2/2005 | Kubo et al. | |
| D509,351 | S | 9/2005 | Kayano et al. | |
| D512,208 | S | 12/2005 | Kubo et al. | |
| D512,818 | S | 12/2005 | Mitani et al. | |
| D512,819 | S | 12/2005 | Usuki et al. | |
| D512,827 | S | 12/2005 | Usuki et al. | |
| D512,828 | S | 12/2005 | Kubo et al. | |
| D513,115 | S | 12/2005 | Kayano et al. | |
| D514,286 | S | 2/2006 | Kayano et al. | |
| D520,732 | S | 5/2006 | Mitani et al. | |
| D522,229 | S | 6/2006 | Kubo et al. | |
| D542,522 | S | 5/2007 | Fujita et al. | |
| D552,833 | S | 10/2007 | Yamashita et al. | |
| D553,846 | S | 10/2007 | Kayano et al. | |
| 7,322,131 | B2 | 1/2008 | Yamashita et al. | |
| D561,434 | S | 2/2008 | Fujita et al. | |
| D561,442 | S | 2/2008 | Kayano et al. | |
| 7,325,323 | B2 | 2/2008 | Katsu et al. | |
| D571,086 | S | 6/2008 | Yamashita et al. | |
| D571,090 | S | 6/2008 | Fujita et al. | |
| D575,486 | S | 8/2008 | Yamashita et al. | |
| D575,946 | S | 9/2008 | Mitani et al. | |
| D582,658 | S | 12/2008 | Fujita et al. | |
| 7,523,566 | B2 * | 4/2009 | Young-Chul | A43B 13/12 36/28 |
| 7,779,558 | B2 | 8/2010 | Nishiwaki et al. | |
| 7,877,899 | B2 | 2/2011 | Nishiwaki et al. | |
| 7,918,041 | B2 * | 4/2011 | Cho | A43B 7/081 36/28 |
| 7,987,618 | B2 | 8/2011 | Nishiwaki et al. | |
| 8,008,363 | B2 | 8/2011 | Mori et al. | |
| D650,566 | S | 12/2011 | Yamashita et al. | |
| 8,074,377 | B2 | 12/2011 | Nishiwaki et al. | |
| 8,112,909 | B2 | 2/2012 | Kubo et al. | |
| 8,418,379 | B2 | 4/2013 | Nishiwaki et al. | |
| 8,453,344 | B2 | 6/2013 | Nishiwaki et al. | |
| 8,461,222 | B2 | 6/2013 | Mori et al. | |
| 8,544,190 | B2 | 10/2013 | Nishiwaki et al. | |
| D734,927 | S | 7/2015 | Ando et al. | |
| D734,928 | S | 7/2015 | Ando et al. | |
| 9,089,185 | B2 | 7/2015 | Nishiwaki et al. | |
| 2001/0007181 | A1 * | 7/2001 | Cagner | A43B 9/12 36/102 |
| 2005/0268490 | A1 * | 12/2005 | Foxen | A43B 7/1425 36/28 |
| 2005/0268491 | A1 * | 12/2005 | McDonald | A43B 1/0063 36/28 |
| 2009/0241369 | A1 | 10/2009 | Votolato | |
| 2011/0192056 | A1 * | 8/2011 | Geser | A43B 13/26 36/114 |
| 2011/0197468 | A1 | 8/2011 | Kubo et al. | |
| 2013/0333251 | A1 | 12/2013 | Taniguchi et al. | |
| 2014/0015169 | A1 * | 1/2014 | Wan | A43B 9/00 264/328.1 |
| 2014/0041261 | A1 * | 2/2014 | Walker | A43B 3/0057 36/25 R |
| 2015/0013187 | A1 | 1/2015 | Taniguchi et al. | |
| 2015/0082668 | A1 | 3/2015 | Nonogawa et al. | |
| 2015/0135558 | A1 | 5/2015 | Inomata et al. | |
| 2015/0143723 | A1 | 5/2015 | Tateishi et al. | |
| 2015/0181975 | A1 | 7/2015 | Otsuka et al. | |
| 2015/0216258 | A1 | 8/2015 | Ueda et al. | |
| 2015/0250260 | A1 | 9/2015 | Bessho et al. | |
| 2016/0015122 | A1 | 1/2016 | Nishiwaki et al. | |
| 2016/0037859 | A1 * | 2/2016 | Smith | A43B 5/00 36/114 |
| 2016/0255911 | A1 * | 9/2016 | Fujita | A43B 13/125 |

FOREIGN PATENT DOCUMENTS

| | | | |
|---|---|---|---|
| JP | H04279102 | A | 10/1992 |
| JP | H0565201 | U | 8/1993 |
| JP | H07136003 | A | 5/1995 |
| JP | 2000/201702 | A | 7/2000 |
| JP | 2003/153704 | A | 5/2003 |
| WO | WO-2010/137068 | A1 | 12/2010 |

OTHER PUBLICATIONS

International Search Report Issued in PCT/JP2013/077630 dated Nov. 19, 2013.

* cited by examiner

SHOE SOLE

CROSS-REFERENCE TO RELATED APPLICATION

The present application claims priority to and is a national stage application, filed under 35 U.S.C. § 371, of International Application No. PCT/JP2013/077630, filed on Oct. 10, 2013, the contents of which fully incorporated herein by reference in its entirety.

TECHNICAL FIELD

The present invention relates to an improvement to a shoe sole having a structure in which an outsole is arranged under a midsole.

BACKGROUND ART

A shoe sole is generally required to be light-weight, durable, gripping, shock-absorbing, bendable, etc., and each of these properties needs to be on a certain level or better while some of them are in a tradeoff relationship. In recent years, there has been a demand for better designing the tread surface of a shoe sole and for taking environmental considerations with a shoe sole.

With court shoes, cross-training shoes, etc., for example, the outsole often covers the entire surface of the midsole in view of the durability and the gripping property. However, an outsole, which is made of a non-foamed rubber material or a rubber material with a small expansion ratio, covering the entire surface of the midsole leads to an increase in the weight of the shoe sole. Conversely, if the midsole is partially exposed for a reduced weight, such exposed portions will generate weaknesses in view of durability.

CITATION LIST

Patent Literature

First Patent Document: JP05-065201Y (front page)
Second Patent Document: JP01-154805Y (front page)
Third Patent Document: JP63-172302Y (front page)
Fourth Patent Document: JP07-136003A (front page)

SUMMARY OF INVENTION

An object of the present invention is to provide a shoe sole that can be expected to suppress the durability lowering and to be light-weight, gripping and shock-absorbing, as well as being adequately bendable. Moreover, one can also expect that it accommodates a greater design variety while taking environmental considerations.

A shoe sole of the present invention includes:

an outsole 1 made of a rubber having a tread surface 10 and an upper surface 11; and a mid sole 2 having an upper surface 21 and a lower surface 20, wherein the lower surface 20 is attached to the upper surface 11 of the outsole 1, and a main (primary) component of the mid sole 2 is a foam body having a thermoplastic resin component, wherein:

the outsole 1 includes:

a plurality of cleats C1 arranged while being spaced apart from one another in a first direction D1; and a plurality of cleats C1 arranged while being spaced apart from one another in a second direction D2 crossing (intersecting) the first direction D1;

ones of the cleats C1 (i.e., the cleats arranged in the first and second directions) that are adjacent to each other in a third direction D3 crossing the first and second directions are continuous with each other in the third direction D3 via a first connecting portion 12 of the outsole;

ones of the cleats C1 (i.e., the cleats arranged in the first and second directions) that are adjacent to each other in a fourth direction D4 crossing the first, second and third directions D1 to D3 are continuous with each other in the fourth direction D4 via a second connecting portion 13 of the outsole;

a plurality of through holes H are provided, each through hole H being defined in an area surrounded by three or more of the cleats C1 (i.e., the cleats arranged in the first and second directions); and the lower surface 20 of the mid sole 2 includes:

an attachment surface 22 attached to the upper surface 11 of the outsole 1, and an exposed surface 23 of the foam body exposed through the through holes H.

According to the present invention, the through holes H of the outsole 1 and the exposed surfaces 23 are adjacent to each other, each being surrounded by three or more cleats C1. Therefore, for each cleat C1, the deformation independence of the cleat C1 is exerted because of the through holes H and the exposed surfaces 23.

That is, the rigidity (stiffness) of each cleat C1 is not reinforced by the surrounding outsole 1 or by other cleats C1 but remains flexible. Therefore, each cleat C1 easily undergoes a shear deformation and a compressive deformation. This will improve the gripping property for catching the ground (floor) surface, and one can also expect an improvement to the shock-absorbing property.

On the other hand, the through holes H formed in the outsole 1 are helpful in reducing the weight of the outsole 1.

Now, the midsole 2 and the outsole 1 are joined (integrated) together, by being bonded or welded together, thereby increasing the thickness, thus significantly increasing the rigidity (stiffness) against flexure, i.e., the flexural rigidity $EI_Z$ (E: Young's modulus, and $I_Z$: moment of inertia of area). The flexural rigidity $EI_Z$ is generally in proportion to the thickness of the sole squared. Therefore, the through holes H formed in the outsole 1 contribute to the lowering of the flexural rigidity $EI_Z$, which will improve the bendability of the shoe sole.

Moreover, since a plurality of through holes H are provided in the outsole 1, of which the specific gravity is much larger than that of the midsole 2, it is possible to reduce the weight and it is also more desirable for the environment.

The cleats C1 of the outsole 1 are continuous with each other in the third direction D3 and in the fourth direction D4 via the first connecting portion 12 and the second connecting portion 13, thus suppressing an increase in the number of components (members) while reducing the weight.

Moreover, the plurality of through holes H are each surrounded by three or more cleats C1 and are not continuous with each other. Thus, such structure can suppress the lowering of the durability.

The surface of the midsole 2 typically has a different color from the outsole 1 and/or a beautiful texture, and the plurality of exposed surfaces 23 and the outsole 1 forming a contrast in color therebetween will be helpful in increasing the design variety of the shoe sole.

Herein, the outsole 1 made of a rubber is formed by a foamed rubber material (a rubber foam) having a relatively small expansion ratio or a non-foamed rubber material (a non-foam of rubber), and the outsole 1 has a greater specific gravity than the midsole 2 but is superior in wear resistance.

The foam body of the midsole 2 includes a component of the thermoplastic tread surface 10 and any other suitable component. Examples of the thermoplastic resin component may include a thermoplastic elastomer and a thermoplastic resin.

Example types of the thermoplastic elastomer may include a styrene-based elastomer such as styrene-ethylene-butylene-styrene block copolymer (SEBS), and an ethylene-vinyl acetate copolymer (-based) elastomer.

Example types of the thermoplastic resin may include a vinyl acetate-based resin such as ethylene-vinyl acetate copolymer (EVA), polystyrene, and a styrene-butadiene resin. The resin components listed above may be used alone or in combination of two or more.

As used in the present invention, "a main (primary) component being a foam body" means that a half or more of the upper surface 21 or the lower surface 20 of the midsole 2, or a half or more of the volume of the midsole 2, is formed by a foam body and that the midsole 2 may partially include gel, pod-like members (pods), and the like.

DESCRIPTION OF EMBODIMENTS

Figure 1A:
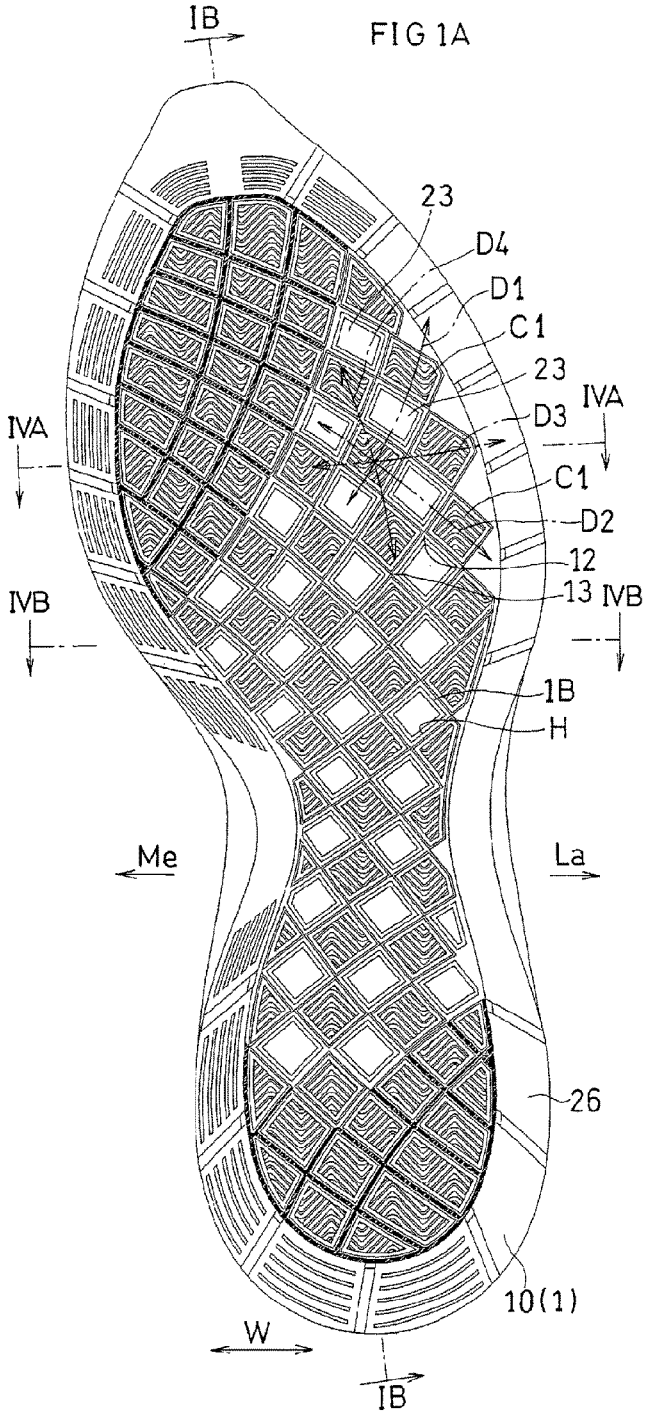
FIG. 1A is a bottom view of a shoe sole showing one embodiment of the present invention.

Preferably, the upper surface 21 of the mid sole 2 is continuous across (over) ones of the plurality of exposed surfaces 23 that are adjacent to each other and the attachment surface 22 attached to the first or second connecting portion 12, 13; and the outsole 1 is necked (constricted, recessed, or narrowed) as if it were cut out (hollow out, or gouge out) as seen in a plan view at each first or second connecting portion 12, 13 between cleats C1 that are adjacent to each other in the third or fourth direction D3, D4.

In such a case, the outsole 1 is necked as if it were cut out as seen in a plan view at each first or second connecting portion 12, 13. This improves the aforementioned deformation independence of the cleats C1 adjacent to each other. This will further improve the gripping property and the shock-absorbing property.

The necked portions will improve the light-weightness, the bendability, etc.

More preferably, the upper surface 21 of the mid sole 2 is continuous across (over) ones of the plurality of exposed surfaces 23 that are adjacent to each other and the attachment surface 22 attached to the first connecting portion 12;

the upper surface 21 of the mid sole 2 is continuous across (over) ones of the plurality of exposed surfaces 23 that are adjacent to each other and the attachment surface 22 attached to the second connecting portion 13;

the outsole 1 is necked (constricted, recessed, or narrowed) as seen in a plan view at each first connecting portion 12 between cleats C1 that are adjacent to each other in the third direction D3; and the outsole 1 is necked (constricted, recessed, or narrowed) as seen in a plan view at each second connecting portion 13 between cleats C1 that are adjacent to each other in the fourth direction D4.

In such a case, the outsole 1 is necked as if it were cut out (hollow out, or gouge out) as seen in a plan view at each of both the first and second connecting portions 12 and 13. This will further improve the aforementioned deformation independence of the cleats C1 adjacent to each other.

Preferably, three or more through holes H are provided, and the cleats C1 are arranged so that each cleat C1 is adjacent to the three or more through holes H and the cleat C1 is surrounded by the three or more through holes H around this cleat.

In such a case, each cleat C1 is surrounded by through holes H. Therefore, the aforementioned independence of each cleat C1 will improve.

Preferably, the plurality of exposed surfaces 23 are arranged while being spaced apart from one another in the first direction D1 and are arranged while being spaced apart from one another in the second direction D2;

ones of the plurality of exposed surfaces 23 that are adjacent to each other in the third direction D3 are made discontinuous (intermittent) in the third direction D3 with each other by the second connecting portion 13 of the outsole 1; and ones of the plurality of exposed surfaces 23 that are adjacent to each other in the fourth direction D4 are made discontinuous (intermittent) in the fourth direction D4 with each other by the first connecting portion 12 of the outsole 1.

In such a case, as the exposed surfaces 23 of the midsole 2 are discontinuous with each other, it is possible to suppress the flexural rigidity of the shoe sole becoming locally too small.

Preferably, a level (e.g., height above ground) of the lower surface 14 of the first or second connecting portion 12, 13 is set to be above the tread surface 10 of the cleats C1 (i.e., the cleats arranged in the first and second directions).

In such a case, the average thicknesses T2 and T3 of the first and second connecting portions 12 and 13 will be smaller than the average thickness T1 of each of the cleats C1, which will improve the aforementioned independence of each cleat C1.

Preferably, the plurality of through holes H are provided in a plurality of rows and in a plurality of columns; and the plurality of exposed surfaces 23 are provided in a plurality of rows and in a plurality of columns.

Rows and columns of through holes H and exposed surfaces 23 will improve the aforementioned independence of the cleats C1.

Preferably, a pitch (distance, or frequency) between the plurality of cleats C1 in each row and in each column is set in a range of 4 to 40 mm; and a pitch (distance, or frequency) between the plurality of through holes in each row and in each column is set in a range of 4 to 40 mm.

If the pitches are less than 4 mm, the outsole 1 may have a fine mesh-like pattern, which may detract from the aforementioned independence of the cleats.

On the other hand, if the pitches are over 40 mm, the ground contact area of each cleat C1 increases, and then even if the cleats C1 appear to be independent of each other, it will detract from the functions derived from the independence.

In view of this, the pitches are more preferably 10 to 40 mm, and most preferably 15 to 35 mm. Note however that there may be some cleats where the pitch therebetween is less than 4 mm or over 40 mm.

Preferably, an opening area (an aperture area) of each of the through holes H is set in a range of 4 to 400 $mm^2$.

If the opening area of each through hole H is less than 4 $mm^2$, the continuity of the outsole 1 will increase, thereby detracting from the independence of the cleats C1.

On the other hand, if the opening area of each through hole H is over 400 $mm^2$, there will locally be small-rigidity areas and large-rigidity areas, hindering the stable support of the foot sole.

In view of this, the opening area is preferably 25 to 300 $mm^2$, and most preferably 36 to 250 $mm^2$. Note however that there may be some through holes H less than 4 $mm^2$ or over 400 $mm^2$.

Preferably, a protruding (projecting) surface 24 protruding downward below (lower than) the attachment surface 22 while being located above (higher than) the tread surface 10; and a non-protruding (non-projecting) surface 25 provided around the protruding surface 24 and being continuous with the attachment surface 22 are included.

In such a case, the protruding surface 24 is formed by the surface of the midsole 2. This protruding surface 24 will function as a soft cleat.

Moreover, when one steps on a hard projecting object on the through hole H, awkwardness will unlikely be felt on the foot sole.

The amount of dirt or mud to get stuck in the through hole H between the cleats C1 and C1 of the outsole 1 will be reduced.

Preferably, the tread surface 10 is protruding in the downward direction below (lower than) the protruding surface 24 by 0.5 to 5 mm.

If the tread surface 10 is protruding in the downward direction past the protruding surface 24 by more than 5 mm, a large amount of dirt may get stuck in the through hole H even with the protruding surface 24 provided.

On the other hand, where the protrusion height by which the tread surface 10 protrudes past the protruding surface 24 is less than 0.5 mm, when the outsole 1 contacts the ground, the protruding surface 24 of the midsole 2 also contacts the ground, in which case the surface of the flexible midsole 2 will likely be scratched, deteriorating the appearance of the shoe sole.

In view of this, these values are preferably 1 to 4 mm, and most preferably about 1.5 to 3 mm.

Preferably, an area of one of the plurality of cleats C1 (i.e., cleats arranged in the first and second directions) is greater than an area of one of the plurality of protruding surfaces 24 that is adjacent to said one cleat C1.

In such a case, the slip-preventing (anti-slip) property from the cleats C1 will be better exerted. The area of one cleat C1 means the area surrounded by the outline of the cleat C1, of the area surrounded by the plurality of through holes H.

Preferably, an area of one attachment surface 22 to which one of the plurality of cleats C1 (i.e., cleats arranged in the first and second directions) is attached is greater than an area of one of the plurality of exposed surfaces 23 that is adjacent to said attachment surface 22.

Where an exposed surface 23 is larger than an adjacent attachment surface 22, there will be a large area where the rigidity is small. Then, the stable support of the foot sole may be hindered, and awkwardness may more likely be felt when stepping on an object.

Preferably, an area of one attachment surface 22 to which one of the plurality of cleats C1 is attached is set to 105% to 300% of an area of one of the plurality of exposed surfaces 23 that is adjacent to said attachment surface 22.

If the area ratio is less than 105%, awkwardness, or the like, may more likely be felt as described above.

On the other hand, if the area ratio is over 300%, the area of the attachment surface 22 for one cleat C1 will be excessive, in which case the independence discussed above will less likely be exerted even if the cleats appear to be independent of each other.

In view of this, the area ratio between the area of the attachment surface and the area of the exposed surface is preferably 110 to 350%, and most preferably about 120 to 300%.

Preferably, 6 to 60 of the exposed surfaces 23 and 6 to 60 of the cleats C1 are provided in an intermediate (middle) area $\alpha$ extending between a virtual line L and a calcaneal tuberosity BC, the virtual line L being adjacent to a posterior portion of a ball O1 of a big toe and extending diagonally forward toward a lateral side of a foot.

In the intermediate area $\alpha$, as compared to an area anterior or posterior thereto, the outsole 1 is typically less likely to wear out. Therefore, by providing cleats capable of exerting the independence discussed above in the intermediate area $\alpha$, it is possible to realize the effects discussed above without detracting from the durability of the shoe sole.

Moreover, 6 to 60 exposed surfaces 23 of the midsole 2 will provide a new design for the shoe sole.

In view of the designability, the number of exposed surfaces 23 is preferably 10 to 50, and most preferably about 15 to 45.

Preferably, a Young's modulus of the outsole 1 is greater than a Young's modulus of the midsole 2.

The hardness of a foamed resin material (foam body of resin) or that of a rubber has a strong correlation with the Young's modulus.

The midsole 2 is typically more flexible than the outsole 1, and the hardness of the midsole is much smaller than that of the outsole 1. However, because their hardnesses are measured by using different methods, the concept of Young's modulus is employed instead of their hardness relationship.

Typically, the hardness of the midsole 2 is set to about 40° to 75° in terms of the asker C hardness. On the other hand, the hardness of the outsole 1 is set to about 55° to 70° in terms of the JIS-A hardness. Note that 70° in the JIS-A hardness corresponds to about 86° in the asker C hardness.

EMBODIMENTS

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

An embodiment of the present invention will now be described with reference to the drawings.

The present embodiment is a shoe sole of a shoe for running or walking, for example.

Figure 1B:
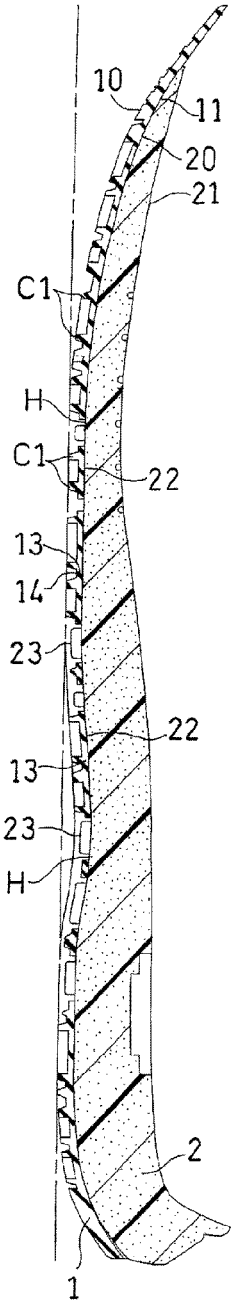
FIG. 1B is a cross-sectional view taken along line IB-IB of FIG. 1A.

As shown in FIG. 1B, the shoe sole includes the outsole 1 made of a rubber, and the midsole 2 made of a resin. Note that an upper (not shown) wrapping around the instep is provided on the shoe sole.

A primary component of the midsole 2 is a foamed material of EVA, for example, and the midsole 2 may include a reinforcement unit (not shown). The midsole 2 may be provided with a low-resilience material, a high-resilience material, a groove, etc.

The outsole 1 is a tread bottom having a greater wear resistance than the foam body of the midsole 2, and typically has a greater hardness and a greater Young's modulus than those of the foam body of the midsole 2. Note that "made of a rubber" herein means that it contains a component of a natural rubber or a synthetic rubber, and may contain any other suitable component.

The outsole 1 includes the tread surface 10 and the upper surface 11. The midsole 2 includes the upper surface 21 and the lower surface 20, and the lower surface 20 is attached to the upper surface 11 of the outsole 1.

The midsole 2 generally covers the entire surface of the foot sole. On the other hand, the outsole 1 of FIG. 1A includes a base portion 1B, and many cleats C1 and many through holes H formed on the base portion 1B. The lower surface 20 of the midsole 2 protrudes through the through holes H, thereby forming many exposed surfaces 23.

Figure 5:
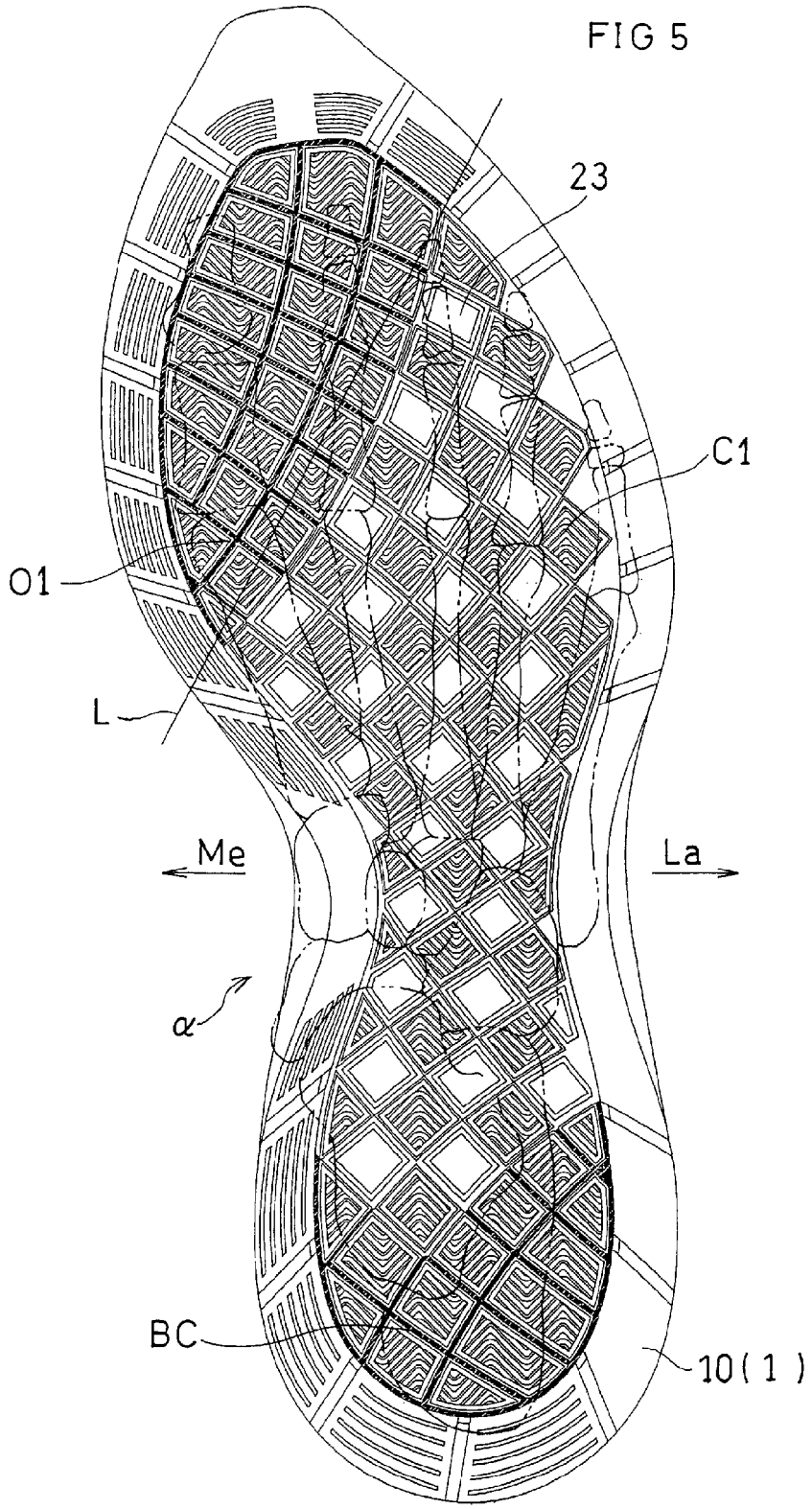
FIG. 5 is a bottom view showing a relationship between the shoe sole and the foot bone structure.

In the present embodiment, a perimeter (circumferential) edge 26 of the outsole 1 is in a continuous loop shape. Many cleats C1 are provided in the area delimited (surrounded) by the perimeter edge 26. Moreover, as shown in FIG. 5, many exposed surfaces 23 and many cleats C1 are provided in the intermediate area $\alpha$ extending between the virtual line L and the calcaneal tuberosity BC, the virtual line L being adjacent to a posterior portion of the ball O1 of the big toe and extending diagonally forward toward the lateral side of the foot.

Note that in the present embodiment, for example, the area ratio of the through holes H with respect to the area of the outsole 1 (the open area ratio) is larger on the lateral side La of the foot than on the medial side Me of the foot. Therefore, it is possible to suppress overpronation.

Figure 2:
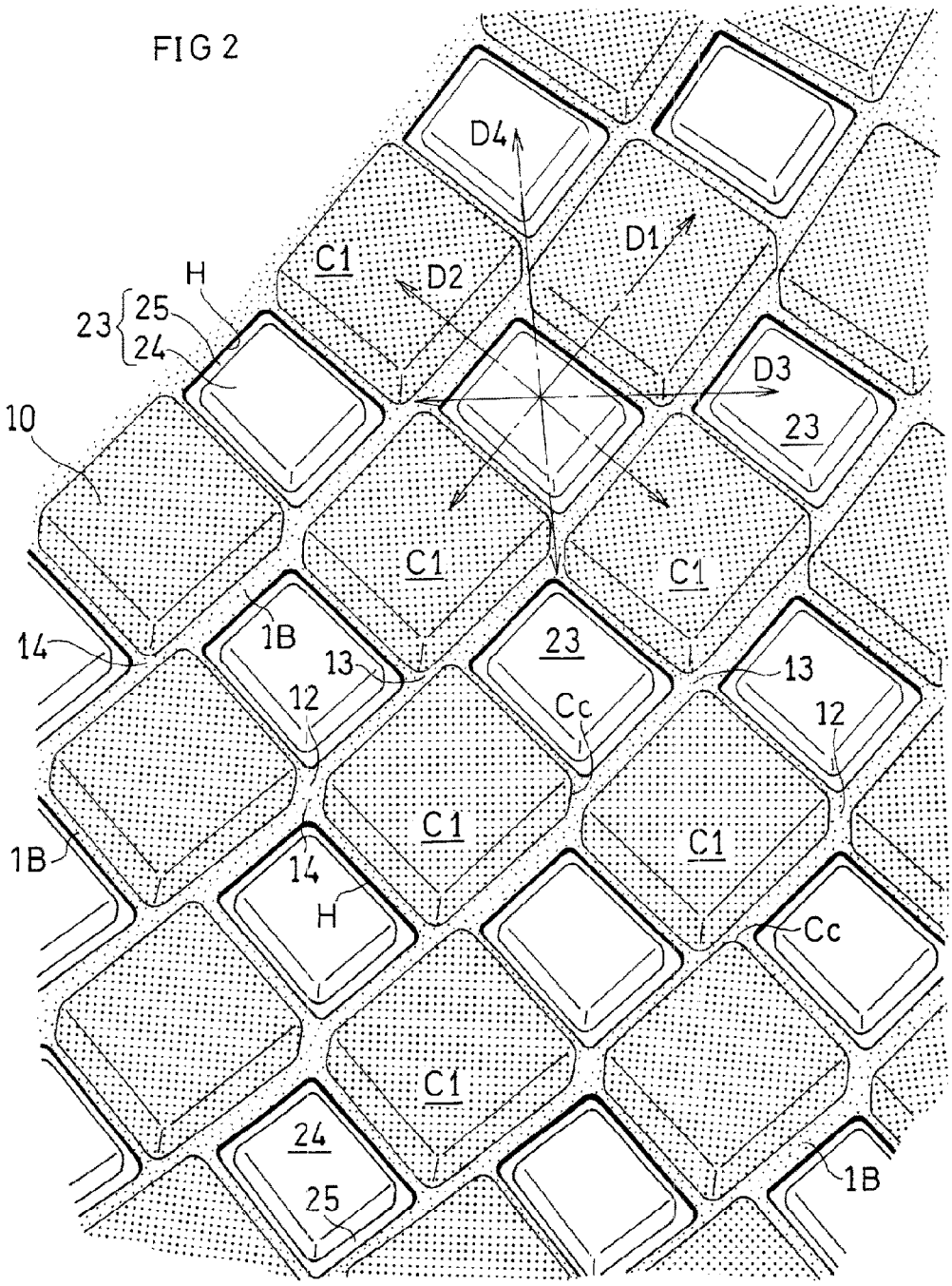
FIG. 2 is a schematic perspective view showing, on an enlarged scale, a main part of the shoe sole of the embodiment.
Figure 3:
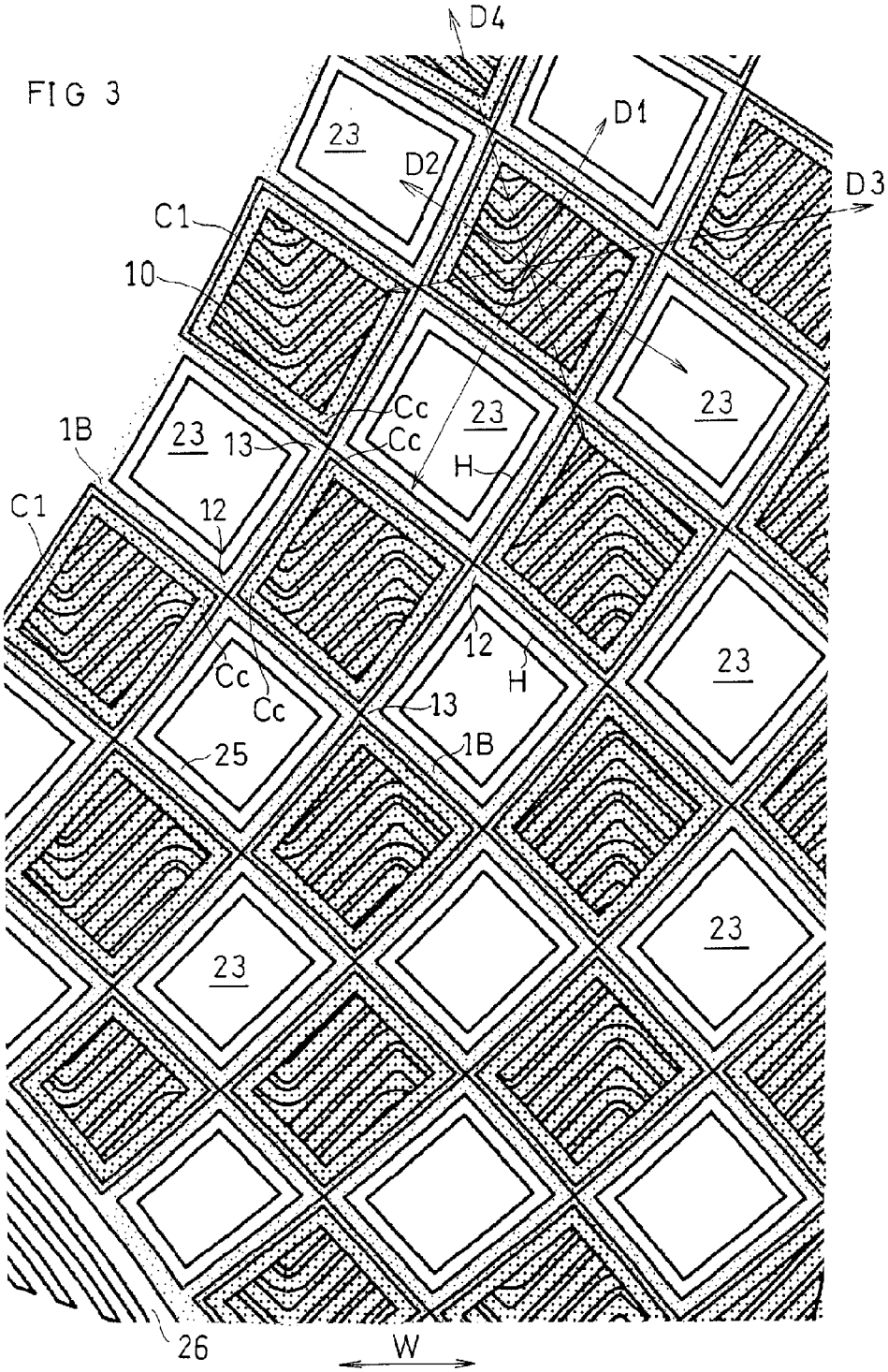
FIG. 3 is a bottom view of the main part.

As shown in FIG. 3 and FIG. 2 on an enlarged scale, the outsole 1 includes a plurality of projecting cleats C1 (one group of cleats) arranged while being spaced apart from each other in the first direction D1. Another plurality of cleats C1 (another group of cleats) are arranged while being spaced apart from each other in the second direction D2 crossing the first direction D1.

The thin base portion 1B is provided around each cleat C1.

Note that in FIG. 3 and in FIG. 6A to FIG. 8B to be discussed later, areas of the outsole 1 where the cleats C1 are provided are shaded with large dots, whereas the thin base portion 1B is shaded with fine dots. In FIG. 2, the thickness of the thin base portion 1B is represented by the thickness of the line.

In the present embodiment, a plurality of ridges are provided (accommodated) in each cleat C1 shown in FIG. 3, whereas each cleat C1 is shown in FIG. 2 to have a smooth surface instead of having ridges thereon for the sake of illustration.

As shown in FIG. 2 and FIG. 3, ones of the cleats C1 that are adjacent to each other in the third direction D3 crossing the first and second directions D1 and D2 are continuous with each other in the third direction D3 via the first connecting portion 12 of the outsole 1.

Ones of the cleats C1 that are adjacent to each other in the fourth direction D4 crossing the first, second and third directions D1 to D3 are continuous with each other in the fourth direction D4 via the second connecting portion 13 of the outsole 1.

That is, in the present embodiment, the cleats C1, the first connecting portions 12 and the second connecting portions 13 are formed from a single (one sheet of) outsole 1.

The first and second connecting portions 12 and 13 are each formed by a portion of the base portion 1B. That is, the level of the lower surface 14 of the first or second connecting portion 12, 13 is set to be above the tread surface 10 of the cleats C1.

The through holes H are each defined in an area surrounded by four of the cleats C1. Note that as shown in FIG. 1 and FIG. 3, some through holes H are each defined by being surrounded by three cleats C1 and the perimeter edge 26.

Figure 4A:
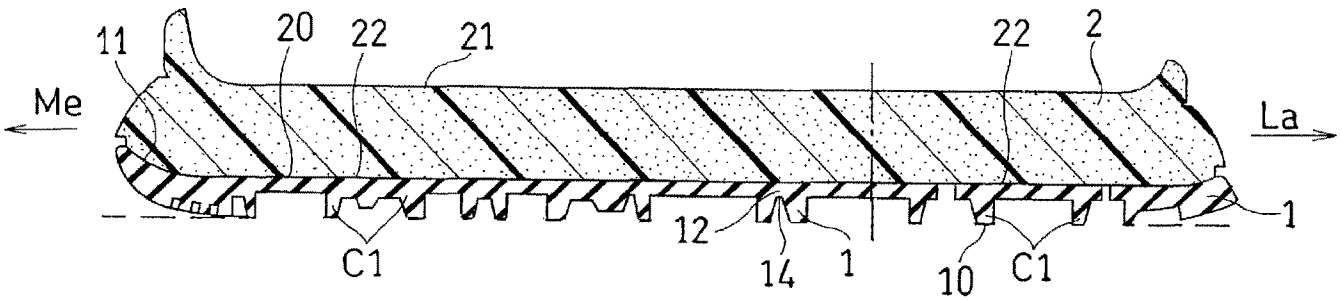
FIG. 4A and FIG. 4B are a cross-sectional view taken along line IVA-IVA of FIG. 1A and a cross-sectional view taken along line IVB-IVB of FIG. 1A, respectively.

The lower surface 20 of the midsole 2 includes attachment surfaces 22 of FIG. 4A attached to the upper surface 11 of the outsole 1, and exposed surfaces 23 of a foamed material exposed through the through holes H.

As shown in FIG. 2 and FIG. 3, the plurality of through holes H are provided in a plurality of rows (preferably in three rows or more) and in a plurality of columns (preferably in three columns or more). Therefore, the plurality of exposed surfaces 23 are provided in a plurality of rows (preferably in three rows or more) and in a plurality of columns (preferably in three columns or more).

Moreover, the plurality of cleats C1 arranged in the first and second direction are provided in a plurality of rows (columns, lines, queues, or alignments) (preferably in three or more rows) and in a plurality of columns (rows, lines, queues, or alignments) (preferably in three or more columns). Thus, the plurality of cleats C1 and the plurality of through holes H are arranged alternating with each other in the first direction D1, and the plurality of cleats C1 and the plurality of through holes H are arranged alternating with each other in the second direction D2. Thus, the cleats C1 and the exposed surfaces 23 form a lattice pattern.

Figure 4B:
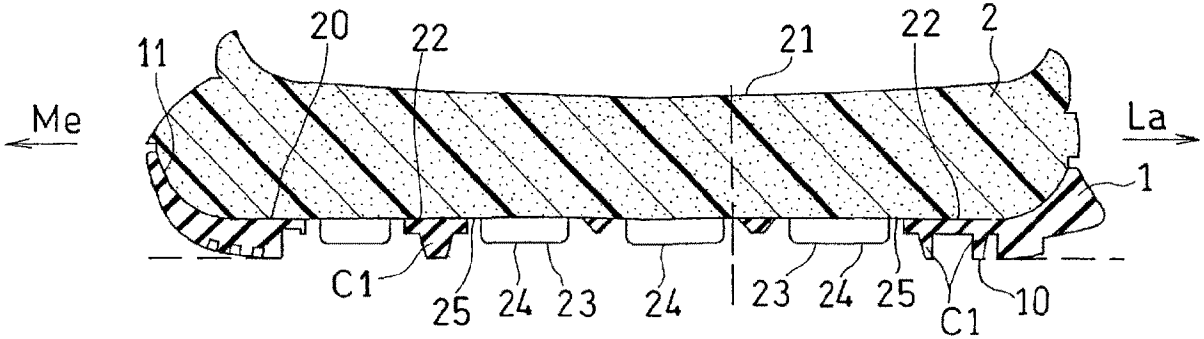

As shown in FIG. 4A and FIG. 4B, the upper surface 21 of the midsole 2 is continuous across ones of the plurality of exposed surfaces 23 that are adjacent to each other and the attachment surface 22 attached to the first connecting portion 12.

As shown in FIG. 1A and FIG. 1B, the upper surface 21 of the midsole 2 is continuous across ones of the plurality of exposed surfaces 23 that are adjacent to each other and the attachment surface 22 attached to the second connecting portion 13.

As shown in FIG. 1 and FIG. 3, the outsole 1 is necked as if it were cut out as seen in a plan view at each first connecting portion 12 between cleats C1 that are adjacent to each other in the third direction D3.

The outsole 1 is necked as if it were cut out as seen in a plan view at each second connecting portion 13 between cleats C1 that are adjacent to each other in the fourth direction D4.

Thus, many cleats C1 with the deformation independence discussed above are molded altogether as an integral piece of a single outsole member, for example.

Note that the meaning of "as seen in a plan view" is generally equal to as seen in a bottom view.

The width W value of each of the connecting portion 12 and 13 is preferably 0.8 to 10 mm, more preferably 1 to 7 mm, and even more preferably 1.5 to 6 mm. In such a case, it is possible to exert the deformation independence of the cleats C1, and it will be unlikely that the first and second connecting portions 12 and 13 are cut off when being molded.

As shown in FIG. 1 to FIG. 3, the plurality of exposed surfaces 23 are arranged while being spaced apart from each other in the first direction D1, and are arranged while being spaced apart from each other in the second direction D2.

Note that as shown in FIG. 4B, on (along) the upper surface 21 of the midsole 2, a pair of the exposed surfaces 23 are continuous with each other via the attachment surface 22.

Ones of the plurality of exposed surfaces 23 that are adjacent to each other in the third direction D3 are made discontinuous in the third direction D3 with each other by the second connecting portion 13 of the outsole 1; and ones of the plurality of exposed surfaces 23 that are adjacent to each other in the fourth direction D4 are made discontinuous in the fourth direction D4 with each other by the first connecting portion 12 of the outsole 1.

As shown in FIG. 2, each exposed surface 23 includes a protruding surface 24 and a non-protruding surface 25. The protruding surface 24 protrudes in the downward direction below the attachment surface 22 while being located above the tread surface 10.

The non-protruding surface 25 is provided around the protruding surface 24 and being continuous with the attachment surface 22.

As shown in an enlarged view of FIG. 4B, the tread surface 10 protrudes in the downward direction below the protruding surface 24 by 0.5 to 5 mm, for example.

As shown in FIG. 3, in the present embodiment, each of the first and second connecting portions 12 and 13 is formed between corners Cc of adjacent cleats C1. Thus, the first and second connecting portions 12 and 13 substantially necked, making it more likely that the aforementioned deformation independence of the cleats C1 is exerted.

The area of one of the plurality of cleats C1 is greater than the area of one of the plurality of protruding surfaces 24 that is adjacent to this one cleat C1.

The area of one attachment surface 22 to which one of the plurality of cleats C1 is attached, i.e., the area of one cleat C1 plus the area of the base portion 1B around this cleat C1, is greater than the area of one of the plurality of exposed surfaces 23 that is adjacent to this attachment surface 22.

The area of one attachment surface 22 to which one of the plurality of cleats C1 is attached is set to 105% to 300%, for example, of the area of one of the plurality of exposed surfaces 23 that is adjacent to that attachment surface 22.

The pitch between the plurality of cleats C1 in each row and in each column is set in the range of 4 to 40 mm, for example. The pitch between the plurality of through holes in each row and in each column is set in the range of 4 to 40 mm.

The opening area of each through hole H is set in the range of 4 to 400 $mm^2$, for example.

Next, alternative (other) embodiments will be described.

Figure 6A:
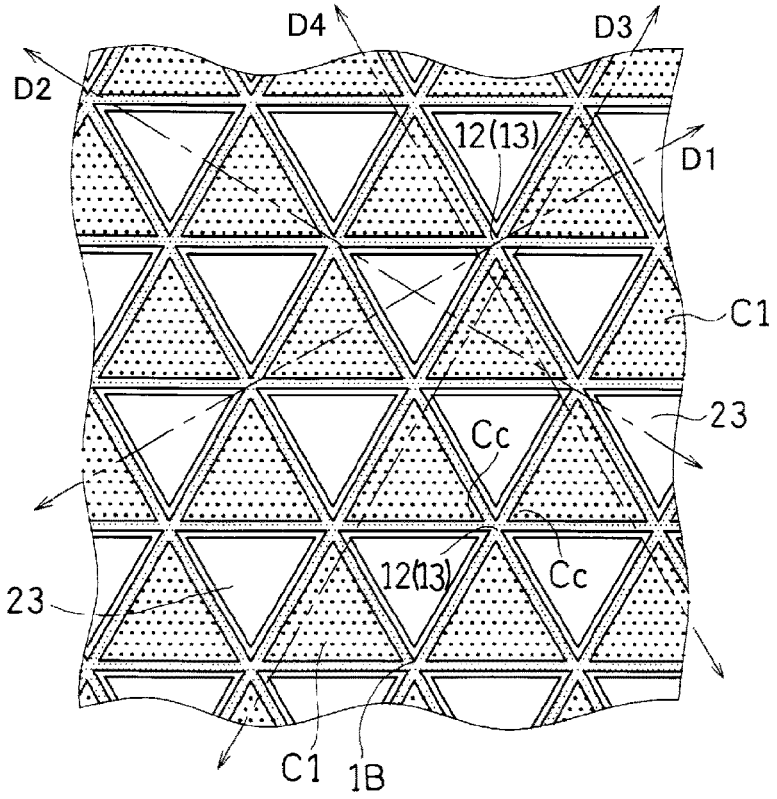
FIG. 6A and FIG. 6B are schematic bottom views each showing an alternative shape and arrangement of cleats and through holes.
Figure 6B:
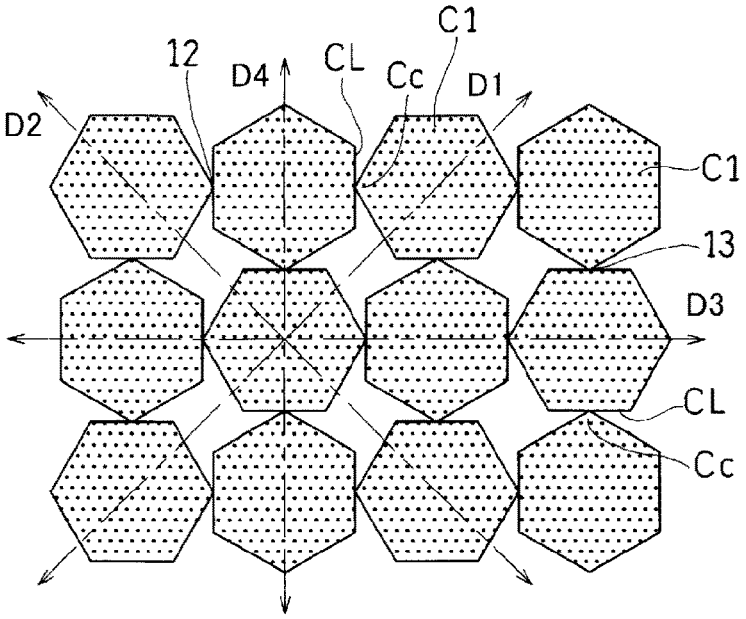
Figure 7A:
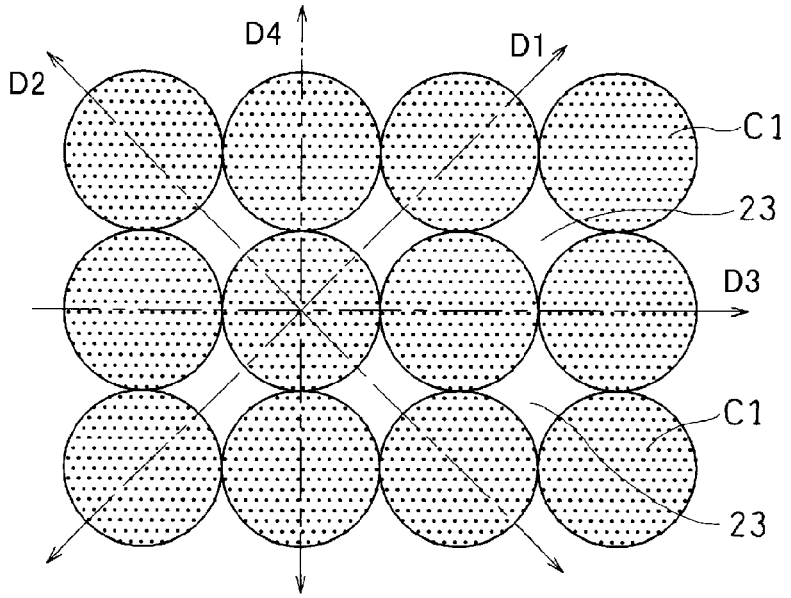
FIG. 7A and FIG. 7B are schematic bottom views each showing an alternative shape and arrangement of cleats and through holes.
Figure 7B:
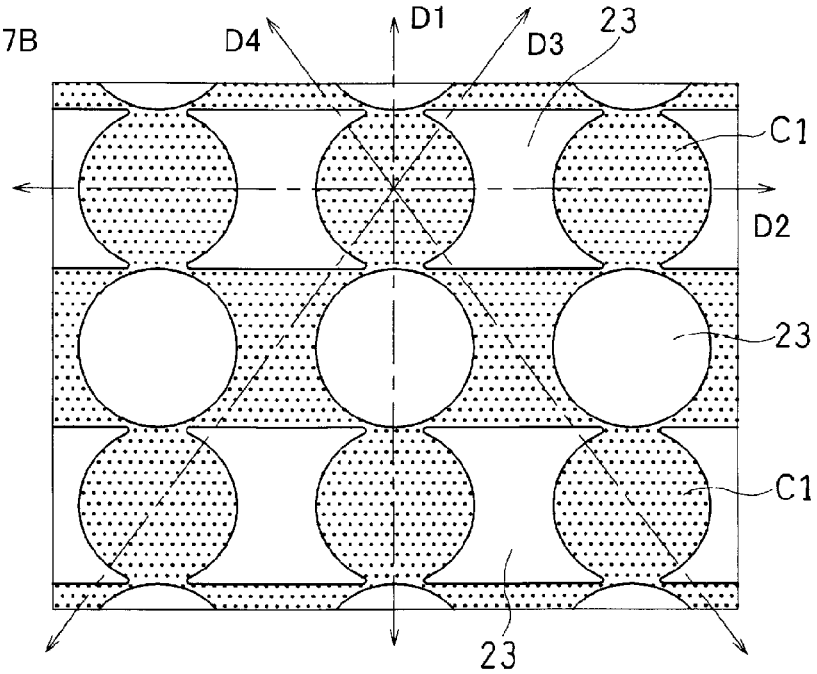

The shape of the cleats C1 may be triangular as shown in FIG. 6A, hexagonal as shown in FIG. 6B, circular as shown in FIG. 7A, or may include different shapes (heteromorphic) as shown in FIG. 7B.

The first and second connecting portions 12 and 13 connecting the cleats C1 together may not be formed by the base portion 1B as shown in FIG. 6A. For example, the first and second connecting portions 12 and 13 may each be formed by a corner Cc of a cleat C1 and a side (straight line or curved line) CL of a cleat C1 as shown in FIG. 6B, or may each be formed by a curve contacting another curve as shown in FIG. 7A.

Nevertheless, if the first and second connecting portions 12 and 13 are each formed between corners Cc of cleats C1 as in the embodiments shown in FIG. 2 or FIG. 6A, a substantially necked portion is formed between cleats C1 and C1, making it more likely that the deformation independence of the cleats C1 is exerted.

Note that in FIG. 6A, locations of the first connecting portion 12 and those of the second connecting portions coincide (overlap) with each other.

Figure 8A:
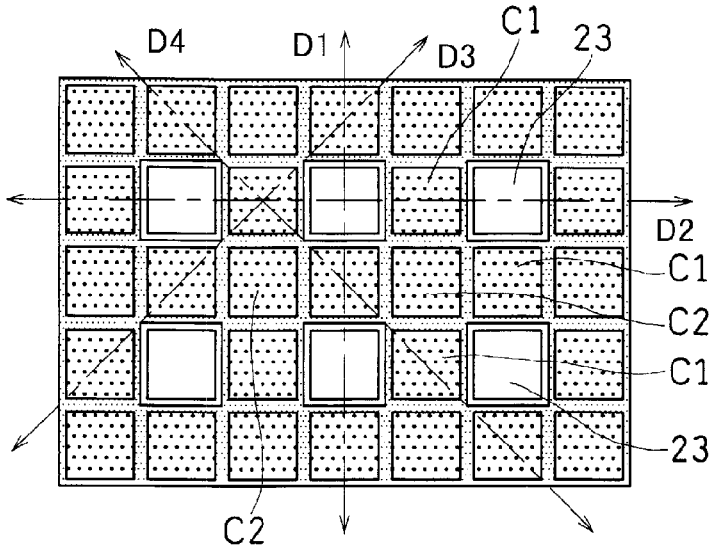
FIG. 8A and FIG. 8B are schematic bottom views each showing an alternative shape and arrangement of cleats and through holes.

In the embodiment of FIG. 8A, each cleat C1 arranged between two through holes H will exert the independence discussed above. Moreover, cleats C1 that are adjacent to one through hole H will exert the independence discussed above to some extent. On the other hand, it may be unlikely that any cleat C2 surrounded by such cleats C1 exerts the independence discussed above.

Figure 8B:
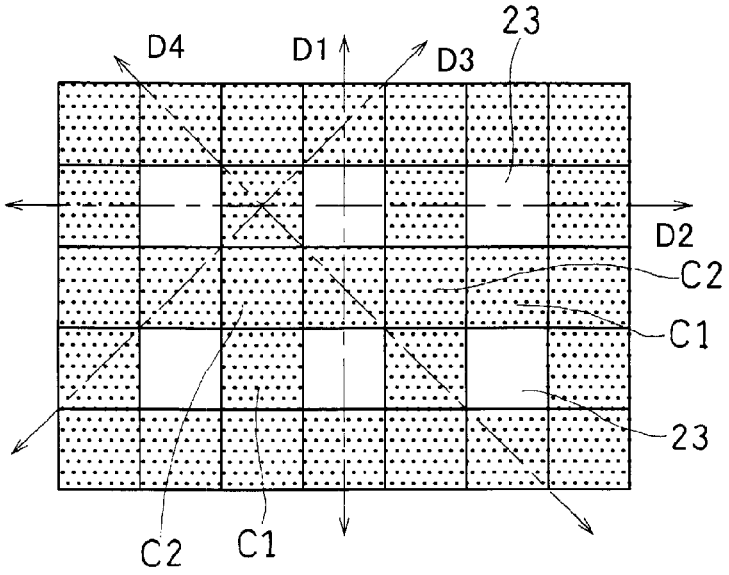

Note that in the embodiment of FIG. 8B, the cleats C1 and the cleats C2 may have an even lower level of the independence discussed above as compared with FIG. 8A.

While preferred embodiments have been described above with reference to the drawings, various obvious changes and modifications will readily occur to those skilled in the art upon reading the present specification.

For example, small depressed (concave) portions or protruding (convex) portions may be formed on the surface of the cleats, instead of ridges formed in the cleats. Moreover, cleats may be formed in a two-step shape.

The protruding surfaces of the midsole may not be provided in the through holes.

Triangular cleats may be arranged, instead of triangular through holes, along the perimeter edge of the outsole. Cutouts (notches), each of which is surrounded by three cleats, may be provided along the perimeter edge of the outsole.

The outsole and/or the midsole may be formed by a plurality of layers of outsole material (member) and a plurality of layers of midsole material (member), respectively.

Thus, such changes and modifications are deemed to fall within the scope of the present invention, which is defined by the appended claims.

INDUSTRIAL APPLICABILITY

The present invention is applicable to the shoe sole of shoes for a stroll and shoes of daily use, as well as to the shoe sole of athletic shoes, such as running shoes and walking shoes.

REFERENCE SIGNS LIST

1: Outsole, 10: Tread surface, 11: Upper surface, 12: First connecting portion, 13: Second connecting portion, 14: Lower surface 2: Midsole, 20: Lower surface, 21: Upper surface, 22: Attachment surface, 23: Exposed surface, 24: Protruding surface, 25: Non-protruding surface, 26: Perimeter edge BC: Calcaneal tuberosity C1: Cleat, C2: Cleat, Cc: Corner, CL: Side D1: First direction, D2: Second direction, D3: Third direction, D4: Fourth direction H: Through hole L: Line O1: Ball of big toe α: Intermediate area

The invention claimed is:

1. A shoe sole comprising:

an outsole made of a rubber having a tread surface and an upper surface; and a mid sole having an upper surface and a lower surface, wherein the lower surface is attached to the upper surface of the outsole, and a main component of the mid sole is a foam body having a thermoplastic resin component, wherein:

the outsole includes:

a plurality of first rows each including a plurality of cleats arranged while being spaced apart from one another in a first direction; and a plurality of second rows each including a plurality of cleats arranged while being spaced apart from one another in a second direction crossing the first direction;

ones of the cleats, included in the first and second rows, that are adjacent to each other in a third direction crossing the first and second directions are continuous with each other in the third direction via a first connecting portion of the outsole;

ones of the cleats, included in the first and second rows, that are adjacent to each other in a fourth direction crossing the first, second and third directions are continuous with each other in the fourth direction via a second connecting portion of the outsole;

a plurality of through holes are provided, each of the through holes being defined in an area surrounded by three or more of the cleats included in the first and second rows; and the lower surface of the mid sole includes:

attachment surfaces attached to the upper surface of the outsole, and exposed surfaces of the foam body exposed through the through holes, the plurality of cleats and the plurality of through holes in the plurality of first rows are arranged alternating with each other in the first direction, the plurality of cleats and the plurality of through holes in the plurality of second rows are arranged alternating with each other in the second direction, the plurality of cleats and the exposed surfaces in the first and second rows form a lattice pattern, and the exposed surfaces include:

protruding surfaces protruding downward below the attachment surfaces while being located above the tread surface; and non-protruding surfaces provided around the protruding surfaces and being continuous with the attachment surfaces.

2. The shoe sole according to claim 1, wherein:

the upper surface of the mid sole is continuous across ones of the exposed surfaces that are adjacent to each other and the attachment surfaces attached to the first or second connecting portion; and the outsole is necked as seen in a plan view at the first or second connecting portion between the cleats that are adjacent to each other in the third or fourth direction.

3. The shoe sole according to claim 1, wherein:

the upper surface of the mid sole is continuous across ones of the exposed surfaces that are adjacent to each other and the attachment surfaces each attached to the first connecting portion;

the upper surface of the mid sole is continuous across ones of the exposed surfaces that are adjacent to each other and the attachment surfaces each attached to the second connecting portion;

the outsole is necked as seen in a plan view at the first connecting portion between the cleats that are adjacent to each other in the third direction; and the outsole is necked as seen in the plan view at the second connecting portion between the cleats that are adjacent to each other in the fourth direction.

4. The shoe sole according to claim 1, wherein:

three or more of the through holes are provided, and the cleats are arranged so that, in a section of the sole, each of the cleats is adjacent to the three or more through holes and a periphery of each of the cleats is surrounded by the three or more through holes.

5. The shoe sole according to claim 1, wherein:

the exposed surfaces are arranged while being spaced apart from one another in the first direction and are arranged while being spaced apart from one another in the second direction;

ones of the exposed surfaces that are adjacent to each other in the third direction are made discontinuous in the third direction with each other by the second connecting portion of the outsole; and ones of the exposed surfaces that are adjacent to each other in the fourth direction are made discontinuous in the fourth direction with each other by the first connecting portion of the outsole.

6. The shoe sole according to claim 1, wherein:

a level of a lower surface of the first or second connecting portion is set to be above the tread surface of the cleats.

7. The shoe sole according to claim 1, wherein:

the plurality of through holes are provided in a plurality of rows and in a plurality of columns; and the exposed surfaces are provided in a plurality of rows and in a plurality of columns.

8. The shoe sole according to claim 7, wherein:

a pitch between the plurality of cleats in each of the rows and in each of the columns is set in a range of 4 to 40 mm; and a pitch between the plurality of through holes in each of the rows and in each of the columns is set in a range of 4 to 40 mm.

9. The shoe sole according to claim 1, wherein:

an opening area of each of the through holes is set in a range of 4 to 400 $mm^2$.

10. The shoe sole according to claim 1, wherein:

the tread surface is protruding downward below the protruding surfaces by 0.5 to 5 mm.

11. The shoe sole according to claim 1, wherein:

an area of one of the plurality of cleats included in the first and second rows is greater than an area of one of the protruding surfaces that is adjacent to the one of the cleats.

12. The shoe sole according to claim 1, wherein:

an area of one of the attachment surfaces to which one of the plurality of cleats included in the first and second rows is attached is greater than an area of one of the exposed surfaces that is adjacent to the one of the attachment surfaces.

13. The shoe sole according to claim 1, wherein:

an area of one of the attachment surfaces to which one of the plurality of cleats included in the first and second rows is attached is set to 105% to 300% of an area of one of the exposed surfaces that is adjacent to the one of the attachment surfaces.

14. The shoe sole according to claim 1, wherein:

6 to 60 of each of the exposed surfaces and the cleats are configured to be provided in an intermediate area extending between a virtual line and a calcaneal tuberosity, the virtual line adapted to be adjacent to a posterior portion of a ball of a big toe and extending diagonally forward toward a lateral side of a foot.

15. The shoe sole according to claim 1, wherein:

a Young's modulus of the outsole is greater than a Young's modulus of the midsole.

16. The shoe sole according to claim 1, wherein:

the plurality of through holes are provided in three rows or more and in three columns or more in the first and second rows, and the plurality of exposed surfaces are provided in three rows or more and in three columns or more in the first and second rows.

* * * * *